United States Patent [19]

Schreiber et al.

[11] 4,311,150

[45] * Jan. 19, 1982

[54] ATHLETIC BRASSIERE

[75] Inventors: Hinda S. Schreiber; Eugenie Z. Lindahl, both of Burlington, Vt.; Polly P. Smith, New York, N.Y.

[73] Assignee: Jogbra Incorporated, Burlington, Vt.

[ * ] Notice: The portion of the term of this patent subsequent to Nov. 20, 1996, has been disclaimed.

[21] Appl. No.: 94,318

[22] Filed: Nov. 13, 1979

Related U.S. Application Data

[63] Continuation of Ser. No. 965,381, Dec. 1, 1978, Pat. No. 4,174,717.

[51] Int. Cl.[3] ..... A41C 3/00

[52] U.S. Cl. ..... 128/494; 128/510

[58] Field of Search ..... 128/494, 510, 429, 424, 128/132, 482, 483; 2/49 R, 104, 44, 67

[56] References Cited

U.S. PATENT DOCUMENTS

| | | | |
|---|---|---|---|
| D. 232,602 | 9/1974 | Greenblatt | D2/24 |
| 1,672,770 | 6/1928 | Mountain | 128/510 |
| 2,926,669 | 3/1960 | Strauss | 128/510 |
| 3,071,140 | 4/1969 | Adler | 128/425 |
| 3,380,454 | 1/1963 | Hoelscher | 128/510 |
| 3,430,632 | 3/1969 | James et al. | 128/425 |
| 3,537,279 | 11/1970 | Epley | 66/176 |
| 3,968,803 | 7/1976 | Hyman | 128/482 |

*Primary Examiner*—Doris L. Troutman

*Attorney, Agent, or Firm*—Browdy and Neimark

[57] ABSTRACT

An athletic brassiere, particularly suitable for women runners, holds the breasts comfortably and snugly to the body. A wide elastic rib band and elastic straps which cross in the back hold the brassiere firmly in place. Non-irritating material is used and all seams face the outside. All hardware is eliminated. The cups are not shaped but are preferably made of elastic material to pull the breasts in snugly against the body.

11 Claims, 5 Drawing Figures

FIG. 3
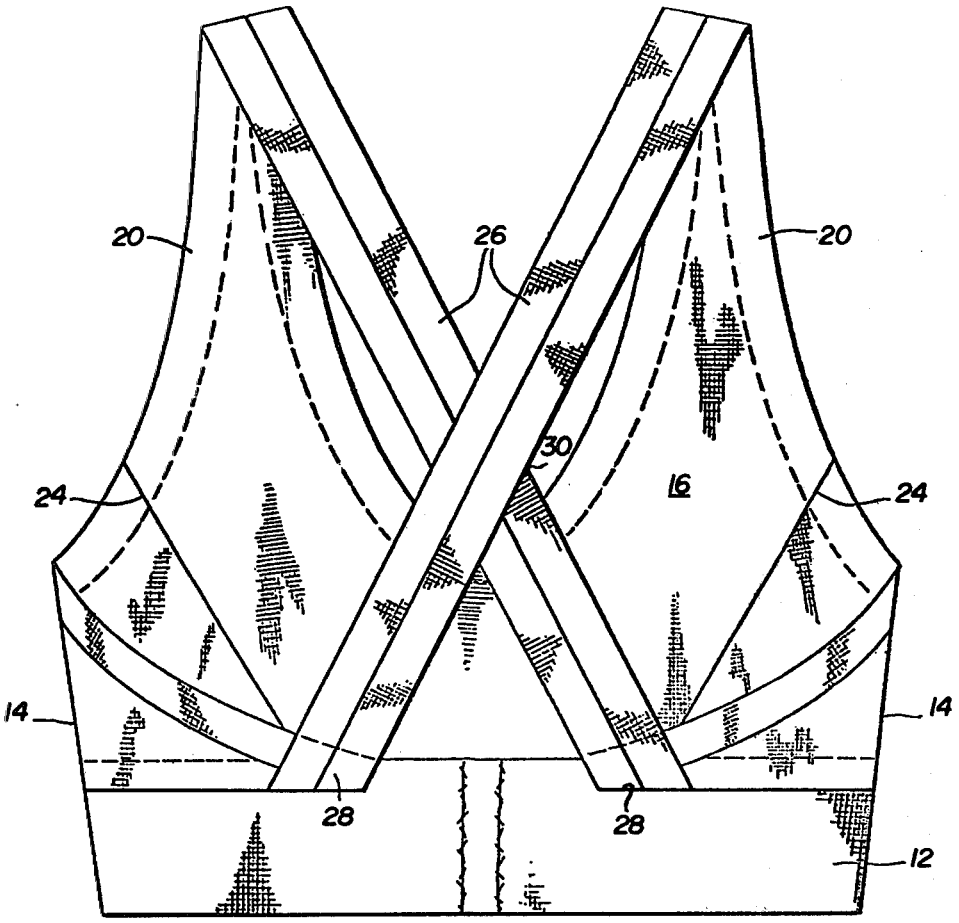
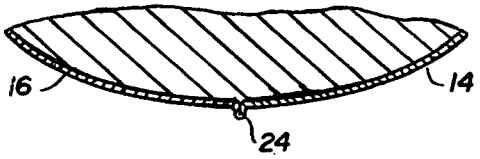
FIG. 4

ATHLETIC BRASSIERE

This is a continuation of application Ser. No. 965,381, filed Dec. 1, 1978 now U.S. Pat. No. 4,174,717.

FIELD OF THE INVENTION

The present invention relates to a supporting brassiere for use by women engaged in athletic activity, particularly jogging, and, more particularly, the present invention relates to such a brassiere which will hold the breasts snugly and comfortably to the body.

BACKGROUND OF THE INVENTION

There has been a long sought need for an adequate athletic supporter for women. Conventional brassieres do not meet the needs of women athletes. Such conventional brassieres have many drawbacks. When the wearer is involved in strenuous athletic activity, there is a tendency for the straps to fall. Furthermore, most conventional brassieres have hardware of some sort, such as hooks for opening and closing the brassiere, underwires, and adjusting bands. Such hardware has a tendency to dig into the body during athletic activity and to be generally quite uncomfortable.

Furthermore, in conventional brassieres, there are seams on the inside of the brassiere which chafe and become very uncomfortable with athletic activity. This is particularly true for such seams on the inside of the cups. Similarly, the usual fabric used for brassieres can become quite irritating when underwires are present and these can cut into the body upon strenuous activity.

Particular problems are faced by female runners, particularly those with relatively large breasts. These problems include the constant bouncing of their breasts which causes breakdown of the breast tissue resulting in premature and unsightly sagging of the breasts; such bouncing also may be bad for the muscles. Another problem is the abrasion caused by the breasts rubbing against the fabric of the runner's clothes. It is not uncommon for marathoners to actually bleed from the nipples after having finished a race.

An adequate supportive and comfortable brassiere for women athletes, particularly runners, has heretofore been absent from the market.

Brassieres are known in the prior art which individually exhibit one or more of the features of the present invention. For example, U.S. Pat. No. 3,430,632 discloses a brassiere having no hardware which is donned by stepping thereinto or by slipping over the shoulders. This brassiere, however, is not designed for use during athletic activities and does not have the wide rib band of the present invention. Furthermore, the seams are on the inside and the cups are designed to shape the breasts. The straps do not cross in the back.

U.S. Pat. No. 2,926,669 discloses a brassiere the straps of which may cross in the back. However, this brassiere includes hardware for opening the brassiere at the front and adjusting the straps. A wide rib band is not provided in the front of the brassiere, and the cups are not designed to hold the breasts snugly to the body. U.S. Pat. No. 3,071,140 also teaches a brassiere which crosses in the back but which has hardware and opens in the front. It is specifically designed, however, to eliminate any rib band.

U.S. Pat. No. 3,537,279 teaches a knit seamless brassiere. However, the straps do not cross in the back and the other features of the present invention are not disclosed thereby.

Halter tops made of leotard type material have been used for athletic support by women but such tops do not provide adequate support, particularly for large-breasted women.

Thus, while various individual features of the present invention are known per se, only by combining the particular features of the present invention in the manner disclosed herein is it possible to accomplish the objects of the present invention.

SUMMARY OF THE INVENTION

Accordingly, it is an object of the present invention to solve the problems of the prior art.

Another object is to provide for improved breast support during rigorous activity.

It is another object of the present invention to provide a new and improved type of brassiere for athletic women which holds the breasts firmly against the body and limits the movement of the breasts.

It is yet another object of the present invention to provide a brassiere with adequate support and comfort for women athletes.

It is still another object of the present invention to provide an athletic brassiere without hardware or internal seams and with straps designed to avoid slipping off of the shoulders, and made of a perspiration resistant material or fabric which eliminates irritation.

It is still another object of the present invention to provide a brassiere that will help avoid the cutting, chafing, bouncing and pain that plague women runners wearing conventional undergarments.

These and other objects and the nature and advantages of the instant invention will be better understood from a consideration of the description of the present invention in conjunction with the attached drawings.

Significant features of the athletic brassiere in accordance with the present invention for accomplishing the above objects include the presence of straps that cross in the back, the absence of any hardware, the provision of all seams on the outside of the brassiere, the use of fabric that minimizes skin irritation, the presence of a wide elastic rib band which holds the brassiere firmly in place, and the design of a front using mildly elastic material without shaped cups.

For a better understanding of the invention, a possible embodiment thereof will now be described with reference to the attached drawings, it being understood that this embodiment is exemplary and not limitative.

BRIEF DESCRIPTION OF THE DRAWINGS

FIG. 3 is a rear view of the brassiere in accordance with the present invention; and FIG. 4 is a cross section taken along lines 4—4 of FIG. 1.

DETAILED DESCRIPTION OF THE PREFERRED EMBODIMENT

Figure 1:
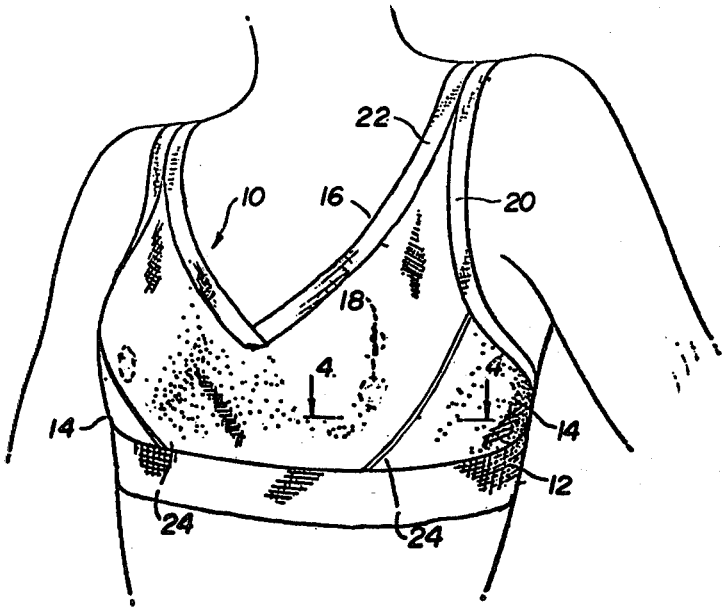
FIG. 1 is a front perspective view of the brassiere as worn.
Figure 2:
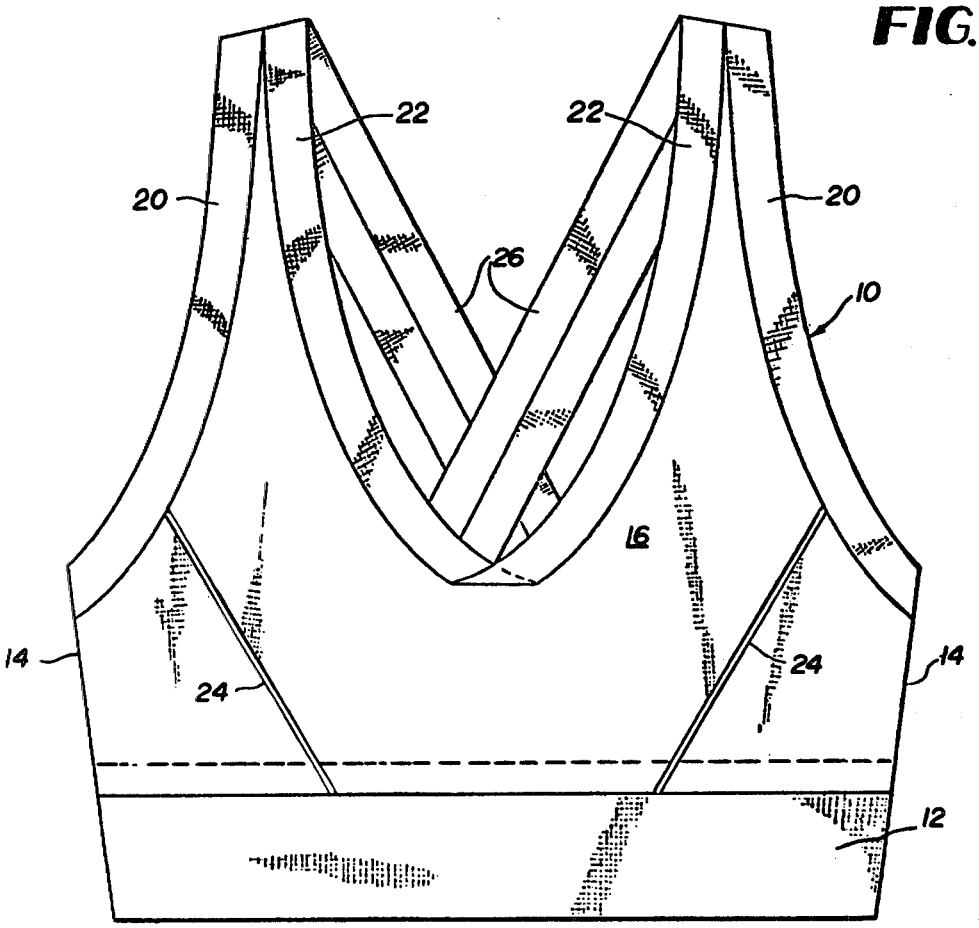
FIG. 2 is a front view of the brassiere in accordance with the present invention.
Figure 5:
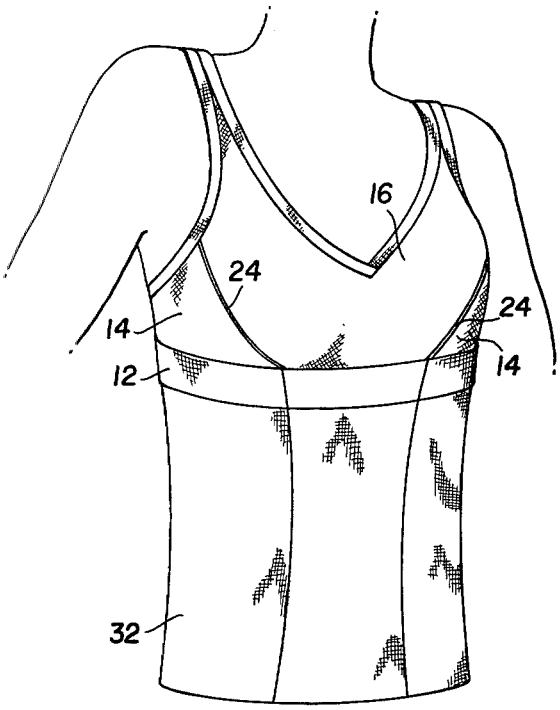
FIG. 5 is a front perspective view of a modified version of the brassiere as worn.

A brassiere 10 in accordance of the present invention as illustrated in FIGS. 1—3, is constructred in halter-style with no hardware of any sort. A front panel 16 made of a single cut of material is sufficiently large to cover the front of both breasts when worn. Front panel 16 is sewn to two side panels 14 in such a manner that the seams 24 face the outside of the brassiere rather than the inside. This is clearly illustrated in FIG. 4. It is important that all seams in the area of the breasts face outside in order to avoid chafing and irritation. Preferably, all seams in the brassiere face outside for this purpose. Furthermore, the placement of the seams 24 should be designed so as not to be directly over the nipples illustrated by dotted circles 18 in FIG. 1.

Preferably, the material of panels 14 and 16 is somewhat elastic in order to give the brassiere strength. For this purpose, a substantial portion of spandex fibers such as Lycra are used in the material. Preferred material is cotton-spandex fabric or cotton-spandex-polyester fabric which are used in swimwear. Such swimwear material is well known to those of ordinary skill in the art. This material is preferred for the brassiere of the present invention not only because it is strong and non-irritating but also because it resists salt from perspiration. One preferred material comprises 42% cotton, 16% Lycra, and 42% polyester. Any kind of material which might tend to chafe or scratch upon use should be avoided.

The bottom of the front panels 16 and side panels 14 are sewn to a wide elastic rib band 12 which continuously encircles the body when worn. This band is preferably 1½ to 2 inches wide in order to prevent riding of the brassiere up or down during use, and to provide comfort without digging. The width is preferably uniform throughout the circumference of the band. This wide rib band 12 holds the brassiere 10 firmly in place and provides strong support for the bottom of the panels 16 and 14 which actually bind the breasts.

Elastic edging material 20 and 22 line the top of the front and the side panels 16 and 14, and merge to form straps 26. It can be seen, particularly from FIG. 3, that the strap on the right side of the wearer connects to the back of the rib band on the left side of the wearer when worn, and and vice-versa for the other strap. In this manner, the straps criss-cross in the back. Use of such elastic straps which cross in the back avoids the problem of the straps falling off of the shoulders and provides adequate support for the top of the front panel 16 to hold the breasts snugly. The specific point of attachment 28 for the straps 26 at the back of the rib band 12 are chosen to avoid the straps from either riding up the neck or down the shoulders. At the area of intersection of the two straps at the back, it is possible, although not necessary, to connect the straps, or to loosely connect them while leaving some degree of leeway of sliding with respect to one another while substantially avoiding separation in the direction perpendicular to the plane of the crossed straps.

In general, with basic seams the edges of the material pieces being joined are folded and then sewn together. The side with the rough edges is generally termed the unfinished side and the opposite side, which is smooth and shows no stitches, is generally termed the finished side. In conventional brassieres, as in other articles of clothing, the finished side faces away from the body. On the contrary, with the present invention it is important that the finished side of all such seams face inwardly, as is shown for seam 24, in order to avoid chafing and irritation.

Furthermore, all construction and, whenever possible, all seams or edges sewn in a manner to create a raised ridge should be arranged to be on the outside rather than the inside of the brassiere. For example, the elastic edging construction 20 and 22 is sewn to the outside of the panel material so that the panel material itself actually serves as a lining for the edging. Also, the straps 26 are sewn to the outside of the back of rib band 12. The intersection of the front panel 16 and side panels 14 with the rib band 12 is also sewn such that any major raised ridges, caused by the manner of binding the edges of the panels, for example, are on the outside of the band 12 to the extent possible. In this manner irritation is minimized.

The brassiere is donned by fitting the brassiere over the head and down onto the body. Althernatively, the brassiere may be stepped into and pulled up over the body.

It is important that the front of the brassiere of the present invention is not shaped to cup the individual breasts but is substantially flat and somewhat elastic in order to pull the breasts in and hold them snugly against the body when the brassiere is in use. The front panel 16 and the side panels 14 of the brassiere, when the brassiere is not worn, have some degree of shaping to allow for the presence of the breasts while still supplying snug support. However, the purpose and design of the brassiere of the present invention is to pull the breasts inwardly, and not to shape the breasts for cosmetic purposes.

While the preferred embodiment illustrated shows the brassiere of the present invention constructed with a single front panel and two side panels, it should be understood that other designs for the fabric panels may be selected, as long as the seams face the outside and all hardware is eliminated. It is possible that rather than a single front panel 16, a pair of front panels may be used, one on each side; however, the individual panels should be shaped to pull in the breasts, not merely to uplift and shape them.

It is also possible to construct the brassiere of the present invention as part of a halter top of T-shirt. For example, decorative fabric may depend from the bottom of rib band 12 to cover the midriff or may be sewn to the brassiere to cover the top and back of the wearer. These are also to be considered as part of the present invention as they do not depart from the scope of the claimed invention.

It will be obvious to those skilled in the art that various other changes may be made without departing from the scope of the invention and the invention is not to be considered limited to what is shown in the drawings and described in the specification.

What is claimed is:

1. An athletic brassiere, comprising:

at least one front panel disposed to cover the front of both breasts when worn, without seams in the vicinity of the nipples, said panel being substantially flat and not shaped to uplift the individual breasts when worn;

at least one side panel sewn to each side of said panel such that the stitches of the seams are on the exterior surface of the panel facing away from the wearer when worn;

a wide elastic rib band connected to the bottom of said front and side panels and extending continuously around the body when worn, the front portion of said band being on the front of the wearer when worn and the back portion being on the back of the wearer when worn;

two elastic straps, one of said straps being connected at one end thereof to said front panel on the right side of the wearer when worn and connected at the other end thereof to the back portion of the said rib band on the left side of the wearer when worn, and the other of said straps being connected at one end thereof to said left front panel on the left side of the wearer when worn and connected at the other end thereof to the back portion of said rib band on the right side of the wearer when worn such that said straps cross in the back when worn; and a skirt of fabric depending from said rib band to cover the midriff of the wearer when worn.

2. A brassiere in accordance with claims 1 or 10 having no hardware.

3. A brassiere in accordance with claims 1 or 10 wherein said rib band has a width of about 1½ to 2 inches.

4. A brassiere in accordance with claims 1 or 10 wherein said front panel is made of elastic material.

5. A brassiere in accordance with claims 1 or 10 wherein said front panel is made of swimwear material.

6. A brassiere in accordance with claims 1 or 10 wherein said front panel is made of a material including spandex fibers.

7. A brassiere in accordance with claim 4 wherein said side panels are also made of elastic material.

8. A brassiere in accordance with claims 1 or 10 wherein all seams and construction are sewn to face away from the wearer when worn.

9. A brassiere in accordance with claims 1 or 10 wherein said front panel comprises a single panel of material.

10. An athletic brassiere, comprising:

at least one front panel disposed to cover the front of both breasts when worn, without seams in the vicinity of the nipples, said panel being substantially flat and not shaped to uplift the individual breasts when worn;

at least one side panel sewn to each side of said front panel such that the stitches of the seams are on the exterior surface of the panel facing away from the wearer when worn;

a wide elastic rib band connected to the bottom of said front and side panels and extending continuously around the body when worn, the front portion of said band being on the front of the wearer when worn and the back portion being on the back of the wearer when worn; and a first elastic strap connected at one end thereof to one side of said front panel or panels, and a second elastic strap connected at one end thereof to the opposite side of said front panel or panels, said straps intersecting in the vicinity of the center of the back of the wearer when worn and being connected to the back portion of said rib band so as to retain said intersection of said straps in said vicinity of the center of the back of the wearer when worn.

11. A brassiere in accordance with claim 10 and further including a skirt of fabric depending from said ribbed band to cover the midriff of the wearer when worn.

* * * * *